United States Patent [19]

Kashiwara et al.

[11] Patent Number: 4,901,688

[45] Date of Patent: Feb. 20, 1990

[54] IGNITION PLUG FOR USE IN INTERNAL COMBUSTION ENGINES AND AN IGNITION PROCESS BY THE USE THEREOF

[76] Inventors: Ryohei Kashiwara, Raitsu Ootori 106, 456-1, Ootori-kitamachi 8-cho, Saka-shi, Osaka-fu; Hideaki Kashiwara, 3-B, 611, 151-30, Ninomaru-cho, Mukojima, Fushimi-ku, Kyoto-shi; Hidehiko Noguchi, 7-14, Taiho 3-chome, Kanan-cho, Minami-kawachi-gun, Osaka-fu; Takeaki Kashiwara, 3, 37-411, Nagayoshidedo 3-chome, Hirano-ku, Osaka-shi, all of Japan

[21] Appl. No.: 313,063

[22] Filed: Feb. 22, 1989

[30] Foreign Application Priority Data

Oct. 26, 1988 [JP] Japan ..... 63-270176

[51] Int. Cl.[4] ..... F02P 1/00

[52] U.S. Cl. ..... 123/169 EL; 123/169 E

[58] Field of Search ..... 123/169 EL, 169 E, 169 ME, 123/169 MG; 313/139, 140, 141, 142, 130; 315/45, 139

[56] References Cited

U.S. PATENT DOCUMENTS

| | | | |
|---|---|---|---|
| 1,360,294 | 11/1920 | Hill | 123/169 EL |
| 1,371,488 | 3/1921 | Jacobson | 123/169 EL |
| 1,963,801 | 6/1934 | O'Marra | 123/169 EL |
| 2,071,572 | 2/1937 | Rabezanna et al. | 123/169 EL |
| 2,096,199 | 10/1937 | Rabazanna | 123/169 EL |
| 2,129,003 | 9/1938 | Grant | 123/169 |
| 2,208,030 | 7/1940 | Holmes | 123/169 EL |
| 2,305,208 | 12/1942 | Trammel, Sr. et al. | 123/169 EL |
| 2,336,569 | 12/1943 | Rabezanna | 123/169 EL |
| 2,368,889 | 2/1945 | Setterblade | 123/169 EL |
| 2,372,867 | 4/1945 | Tognola | 123/169 EL |
| 2,391,459 | 12/1945 | Hensel | 123/169 |
| 2,616,407 | 11/1952 | Thomas | 123/169 |
| 2,944,178 | 9/1956 | Schaub | 313/141 |
| 3,238,447 | 3/1966 | Bychinsky | 123/169 EL |
| 3,313,972 | 4/1967 | Beesch | 313/130 |
| 3,970,885 | 7/1976 | Kasima | 313/141 |
| 4,023,058 | 5/1977 | Lara et al. | 313/139 |
| 4,109,633 | 8/1978 | Mitsudo et al. | 123/169 EL |
| 4,123,998 | 11/1978 | Heintzelman | 123/321 C |
| 4,401,915 | 8/1983 | Kashiwara et al. | 313/142 |
| 4,808,878 | 2/1989 | Kashiwara et al. | 313/141 |

FOREIGN PATENT DOCUMENTS

| | | | |
|---|---|---|---|
| 2479588 | 3/1980 | France | 123/169 EL |
| 25743 | 8/1976 | Japan | 123/169 EL |
| 87331 | 12/1976 | Japan | 123/169 EL |
| 30394 | 7/1986 | Japan | 123/169 EL |
| 11471 | 3/1987 | Japan | 123/169 EL |
| 187501 | 10/1922 | United Kingdom | 123/169 EL |

*Primary Examiner*—Raymond A. Nelli

*Attorney, Agent, or Firm*—Fisher, Christen & Sabol

[57] ABSTRACT

An ignition plug of this invention is characterized in that a ground electrode thereof has a recess that faces the side surface of a single center electrode; more particularly, in the case of an L-shaped ground electrode whose free end is opposed to the center electrode with a spark gas in between, the recess is provided to on the free end of the ground electrode so that it can hold plentiful gas mixture to ignite near the spark gap by increasing its capacity with the increase of distance from the side surface of the center electrode; thus, the farther the igntion proceeds into the recess, the more intensively gas mixture is ignited, whereby instantaneous combustion can be caused in the entire space of a combustion chamber.

9 Claims, 3 Drawing Sheets

IGNITION PLUG FOR USE IN INTERNAL COMBUSTION ENGINES AND AN IGNITION PROCESS BY THE USE THEREOF

This invention relates to an ignition plug used for internal combustion engines of automobiles and the like.

The inventors have developed an ignition plug disclosed in Japanese patent application publication No. sho 62-11471. In the ignition plug, a line of ignition groove is provided to on the other side of a ground electrode to a center electrode so that a small amount of gas mixture in the groove may be ignited in the first place so as to prompt combustion in the whole space of combustion chamber.

In the prior art, although the free end of the ground electrodes, up to which the ignition groove extends, is inwardly bent so as to come close to the side surface of the center electrodes with a spark gap in between, the capacity of the ignition groove to hold gas mixture is made almost the same from one end to the other, so that the ignition power is restricted thereby and cannot be strengthened anymore. For this reason, in an ignition plug of this invention, the free end of a ground electrode facing a center electrode is partially indented in such a way that there forms a recess for holding gas mixture, and the capacity of the recess increases with the increase of distance between the inside surface of the recess and the side surface of the center electrode.

Therefore, once gas mixture on the verge of the recess is ignited by sparks appearing in a spark gap, the ignition proceeds into the recess multiplying ignition seeds so that combustion gas instantaneously expands in the recess in an ideal condition. In consequence, not only is the ignition of gas mixture accelerated inside the recess but also secondarily forming ignition seeds can multiply much more intensively in this ignition plug than in the former one. Because of that, the time before combustion is greatly reduced and combustion gas is intensified so much as to ignite gas mixture in the surroundings as well. The ignition seeds increasingly multiply in the recess in such a stepless manner that the expansion of combustion gas follows in line with it. Thus, compared with conventional ignition plugs, the energy loss in the ignition process can be lessened by balacing the strength of ignition and the depth of the recess.

In order that this invention may be understood more clearly, reference will now be made to the structure and function of this ignition plug according to the attached drawings, in which FIG. 1 is a longitudinal cross-sectional view of an essential part of an ignition plug of this invention;

wherein numeral 8 denotes a location for a pistion, but the piston itself is not shown in the above figures.

Figure 2:
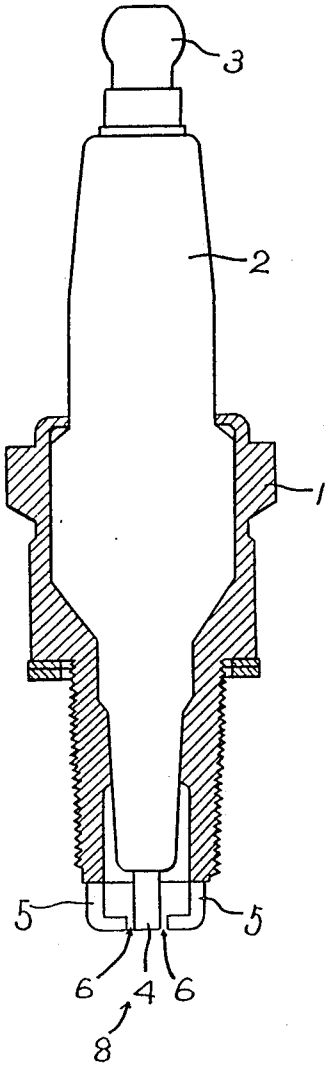
FIG. 2 is a whole elevational view of the same ignition plug as the one in FIG. 1.

Since the ignition plug has to be fixed to an engine block firmly, the outside thereof is provided with an electric conductive metal casing 1 with male thread near the top, as shown in FIG. 2. An insulator 2, usually made of porcelain, which covers a lead connecting a terminal 3 and a cylindrical center electrode 4, is tightly held by the metal casing 1. A pair of rectangular cross-sectioned ground electrodes 5, 5, extended portions of the metal casing are inwardly bent in the middle approximately at right angles toward the center electrode 4. Thus, a spark gap is formed between the side surface 4*a* of the center electrode 4 and the end 5*a* of the ground electrodes 5, 5.

Figure 3:
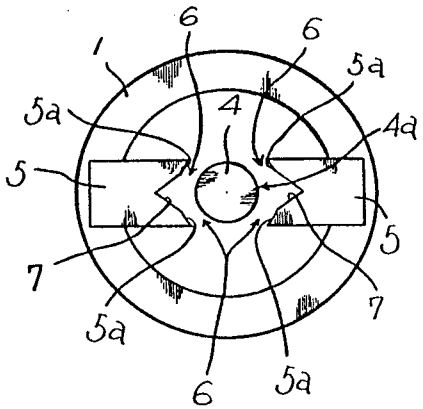
FIG. 3 is a bottom view of the same ignition plug as the one in FIG. 1.
Figure 4:
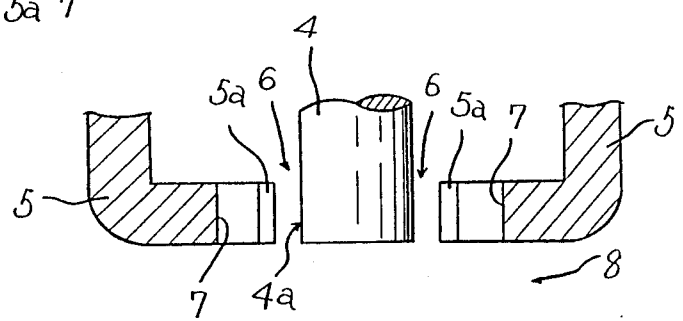
FIG. 4 is a partially enlarged view of an essential part of the same ignition plug as the one in FIG. 1.
Figure 1:
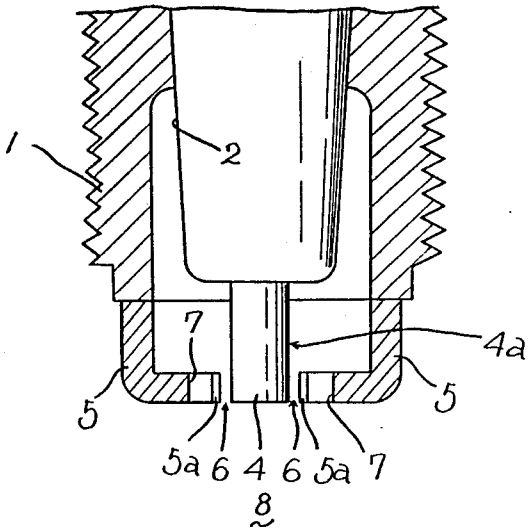

A V-shaped notch 7, which is for holding gas mixture, is made on the end 5*a* of the ground electrodes 5, 5 so that the verge of the notch may span the whole breadth of the ground electrodes, as shown in the bottom view of FIG. 3. In the mean time, the area of the cross section, in other words, the capacity of the notch 4 per unit length steplessly increases with the increase of distance between the inside of the notch and the side surface of the center electrode.

The free end 5*a* of the ground electrodes 5, 5 is notched into such a V-shape that when high voltage is applied between the center and the ground electrodes by way of the terminal 3, there appear sparks in the spark gap 6. That is, flame seeds or primary ignition seeds are given birth to there so as to ignite gas mixture on the verge of the V-shaped notch 7 in the first place. As ignition proceeds into the notch, whose capacity steplessly increase with the increase of its distance from the center electrode 4, combustion also develops steplessly, multiplying secondary ignition seeds. In this way, the whole gas mixture in the combustion chamber is set on fire so instantaneously as to cause strong explosion.

The following table shows the reslut of two running tests actually made on almost the same route in Osaka city by the use of an unloaded ordinary truck (1300 cc, 4 cycles, 4 cylinders), with this ignition plug or with an ordinary marketed ignition plug, provided that in both the running tests, the maximum speed was kept about 60 km/hr., and the average speed lay between 40–60 km/hr.

TABLE

| | Consumed Fuel | Covered mileage | Fuel efficiency | Ratio of efficiency |
|---|---|---|---|---|
| This plug | 11.78 l | 109 km | 9.25 km/l | 130.6% |
| Marketed plug | 16.10 l | 114 km | 7.08 km/l | 100.0% |

Figure 5:
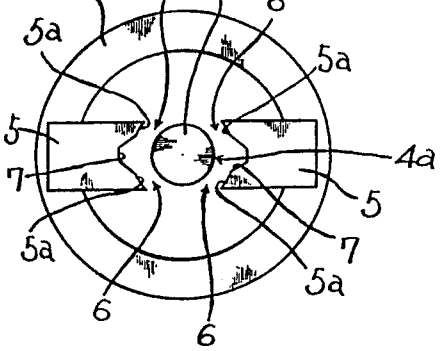
FIG. 5 is a bottom view of a variation of the ignition plug shown in FIGS. 1 through 4.
Figure 6:
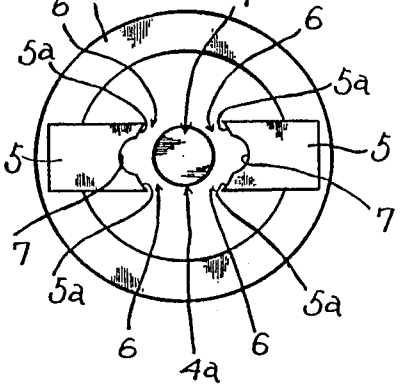
FIG. 6 is a bottom view of another variation of the ignition plug shown in FIGS. 1 through 4.

FIGS. 1 through 4 show only an ignition plug with double ground electrodes; however, it is needless to say that an ignition plug with a single or triple ground electrodes is operatable as well in a similar manner if the end of those ground electrodes is shaped likewise. Moreover, the shape of the notch 7 can be modified as shown in the bottom views of FIGS. 5 and 6, for example. That is, one is modified into a notch with flat bottom, as shown in FIG. 5, and the other is modified into a notch with circular bottom, as shown in FIG. 6. For all such modifications, one can have a desirable effect similar to that of the prototype shown in FIGS. 1 through 4.

Figure 8:
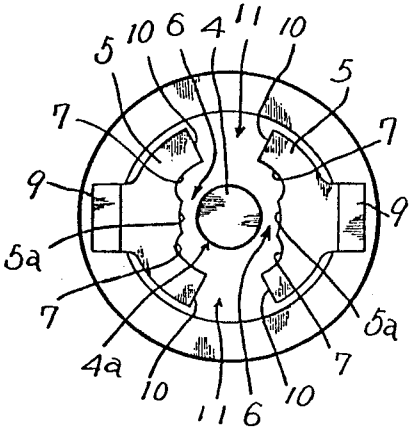
FIG. 8 is a bottom view of the same ignition plug as the one in FIG. 7.
Figure 7:
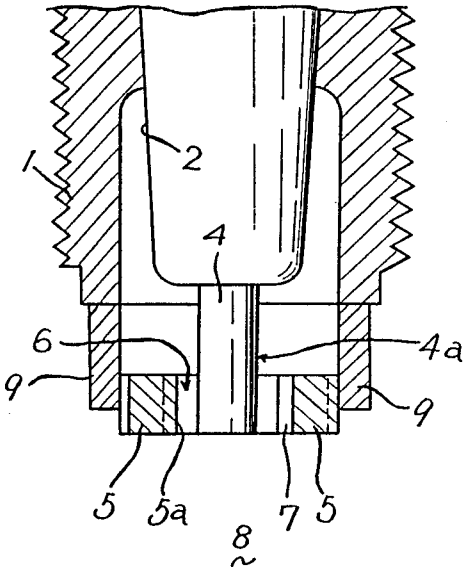
FIG. 7 is a longitudinal cross-sectional view of an essential part of another ignition plug of this invention.

FIGS. 7 and 8 show another example. A pair of crescent ground electrodes 5, 5 are mounted on the top of stays 9, 9 extending from the metal casing 1, the stays being paralleled to the center electrodes 4. As apparent from its bottom view shown in FIG. 8, the end or inside surface of the ground electrodes 5, 5, which defines a spark gap 6 in association with the side surface 4*a* of the center electrode 4, is made so wide as to comprise a circular recess 5*a* in the middle, whose radius of curvature is greater than the radius of the center electrode 4, and two arched recesses 7, 7, whose function is equivalent to that of the notch 7 of the first example, on both sides thereof. Outside the respective arched recesses 7, 7 is a flat face 10; thus, between the flat face 10 of one ground electrode 5 and opposite flat face 10 of the other 5 is a space 11 that outwardly widens.

The configuration of the ground electrodes and the center electrode is such that when sparks appear in the spark gap 6, they give rise to ignition seeds on the verge of the arched recesses 7, 7 where the arched recess and the circular recess meet in the first place. The ignition seeds increase in number, multiplying secondary ignition seeds, and cause combustion, which gas radiantly spreads out from the space 11.

Since the arched recesses 7, 7 on one ground electrode are opposed to the ones 7, 7 on the other respectively with the spark gap 6 in between, there forms an ample space for holding gas mixture the capacity of which steplessly increase with the increase of distance between the surface of the arched recess 7 and the side surface of the center electrode 4. Thereby greater number of ignition seeds can be given birth to there and more instantaneous combustion can result therefrom.

Figure 9:
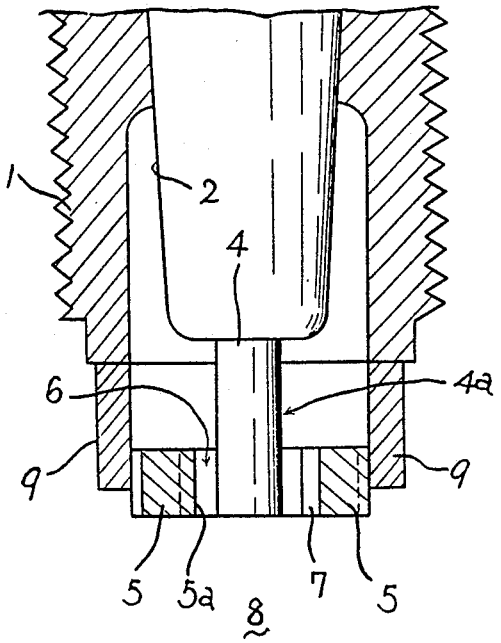
FIG. 9 is a longitudinal cross-sectional view of an essential part of still another ignition plug of this invention.
Figure 10:
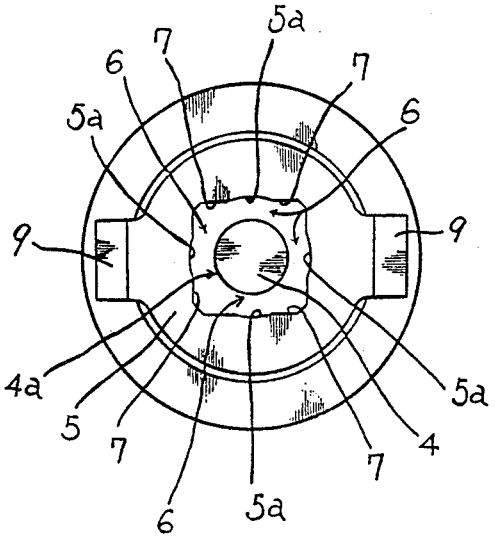
FIG. 10 is a bottom view of the same ignition plug as the one in FIG. 9.

FIGS. 9 and 10 show still another example, in which a pair of ground electrodes 5, 5 in the preceeding examples are made in one so as to form a circle surrounding a center electrode 4. More spaecifically, a round ground electrode 5 is supported by a pair of stays 9, 9 extending from the metal casing 1; and in the middle of the ground electrode 5 is a substantially square hole in the center of which is located the center electrode 4 with a spark gap 6 put on each side of the hole. The sides of the hole comprises a circular portion 5*a* that forms the spark gap 6 in association with the side surface 4*a* of the center electrode 4, and two recesses 7, 7 on both sides of the curcular portion 5*a*. A recess on one side and a recess on the other next form an ample space for holding gas mixture between themselves on every corner of the hole; thus, the capacity of the space attains maximum on the diagonal where the distance between the inside surface of the ground electrode (the side of the hole) and the side surface of the center electrode 4 falls greatest.

The hole has such a shape that gas mixture can be collected in plenty near every corner thereof, the function of which is thus equivalent to the notch 7 of the first example and the recess 7 of the second example. Therefore, when sparks appear in the spark gap 6, there forms a great number of ignition seeds there, and this makes a cause of strong and instantaneous combustion in the entire space of combustion chamber.

Reference has been made to a round ground electrode with a substantially square hole to accommodate a center electrode in the middle; however, it is needless to say that the shape of the hole can be modified into triangle or pentagon in the scope of this invention, and yet one can have a desirable effect with them in a similar manner.

What the inventors claim is:

1. An ignition plug for use in internal combustion engines, in which at least one ground electrode is paired with a center electrode, said ground electrode is inwardly bent in the middle approximately at right angles toward said center electrode so that the end thereof may face the side surface of said center electrode with a spark gap in between, and the top of said center electrode is opposed to a piston with a space in between, characterized in that the end of said ground electrode is partially indented in such a way that there may form a recess for holding gas mixture there and the capacity of said recess may steplessly increase with the increase of the distance between said recess and said center electrode.

2. An ignition plug as claimed in claim 1, in which said recess is formed into a V-shaped notch on the end of said ground electrode.

3. An ignition plug as claimed in claim 2, in which the bottom of said V-shaped notch is made flat.

4. An ignition plug as claimed in claim 2, in which the bottom of said V-shaped notch is made circular.

5. An ignition plug as claimed in claim 1, in which said ground electrode is installed in pairs on both sides of said center electrode, the end of said ground electrode, which defines said spark gap in association with the side surface of said center electrode, is made so wide as to comprise a circular recess in the middle and two arched recesses on both sides thereof, and said arched recesses on one ground electrode are opposed to the ones on the other respectively with said spark gap in between so that there forms an ample space for holding gas mixture there the capacity of which steplessly increase with the increase of distance between the surface of said arched recess and the side surface of said center electrode.

6. An ignition plug as claimed in claim 1, in which said ground electrode is formed into a round form with a substantially square hole in the middle, and supported by at least one stay extending from an electric conductive casing, said hole is made so large as to be able to accommodate said center electrode in the center thereof leaving a spark gap on each side thereof, and two recesses are provided to each side of said hole so that a recess on one side and a recess on the other next may form an ample sapce for holding gas mixture on every corner of said hole where the distance between the side of said hole and the side surface of said center electrode becomes greatest.

7. An ignition plug as claimed in claim 6, in which said hole is formed into a triangular shape.

8. An ignition plug as claimed in claim 6, in which said hole is formed into a pentagonal shape.

9. An ignition process of gas mixture in an ignition plug as claimed in any one of claims 1 through 8, comprising: igniting a smallest amount of gas mixture on the verge of said recess, nearest to said spark gap, on the end of said ground electrode by sparks formed in said spark gap in the first place, and then a larger amount of gas mixture n said recess whose capacity steplessly increases with the increase of distance between said recess and the side surface of said center electrode.

* * * * *